United States Patent [19]

Fogarty

[11] 4,257,752

[45] Mar. 24, 1981

[54] ROTARY ALTERNATING PISTON MACHINE WITH COUPLING LEVER ROTATING AROUND OFFSET CRANKPIN

[76] Inventor: Raymond M. Fogarty, Trinity Towers, 3rd and Guthrie Sts., Louisville, Ky. 40202

[21] Appl. No.: 25,887

[22] Filed: Apr. 2, 1979

[51] Int. Cl.[3] ..... F01C 1/00; F01C 9/00; F04C 21/00

[52] U.S. Cl. ..... 418/34; 418/37; 418/186; 417/481; 91/339; 92/122

[58] Field of Search ..... 418/34, 37; 123/245, 123/43 B; 417/481; 91/339; 92/122

[56] References Cited

U.S. PATENT DOCUMENTS

| | | | |
|---|---|---|---|
| 726,353 | 4/1903 | Sainsevain | 418/34 |
| 1,243,163 | 10/1917 | Gygar | 418/34 |
| 1,628,162 | 5/1927 | Lehnert | 418/34 |
| 3,955,541 | 5/1976 | Seybold | 418/34 |
| 4,169,697 | 10/1979 | Doundoulakis | 418/34 |

FOREIGN PATENT DOCUMENTS

| | | | |
|---|---|---|---|
| 863148 | 1/1953 | Fed. Rep. of Germany | 91/339 |
| 353579 | 7/1905 | France | 418/34 |
| 399956 | 10/1933 | United Kingdom | 418/37 |

*Primary Examiner*—John J. Vrablik
*Attorney, Agent, or Firm*—Richard L. Caslin

[57] ABSTRACT

A rotary piston machine is shown that is operable with a compressible fluid; such as a rotary pump, compressor or engine construction. There is a housing having an inner and an outer ring member that are rotatably mounted on a common axis. The outer ring has at least two diametrically opposed inwardly directed segmental pistons. The inner ring has at least two diametrically opposed outwardly directed segmental pistons so as to define working chambers therebetween. An oscillating coupling means is positioned within the inner ring and flexibly joined to both ring members as well as rotating around a fixed offset crankpin to cause the inner and outer pistons to change position with relation to each other as the two ring members revolve around their common axis so as to create compression and expansion strokes.

13 Claims, 17 Drawing Figures

0' POSITION
360' POSITION

90' POSITION

180' POSITION

270' POSITION

ROTARY ALTERNATING PISTON MACHINE WITH COUPLING LEVER ROTATING AROUND OFFSET CRANKPIN

BACKGROUND OF THE INVENTION

1. Field of the Invention

The invention relates to the construction of rotary pumps, rotary compressors or rotary engines having two or more concentric members with rotating energy chambers formed therebetween. The size of the chambers is modified by a novel oscillatory movement of symmetrically supported radially extending inner pistons toward and away from complementary radially extending outer pistons.

2. Description of the Prior Art

Rotary pumps, compressors and internal combustion engines are well known that have an annular working space that is divided by a pair of rotating members having radially extending pistons into a plurality of energy chambers. The two rotating members perform a differential rotational movement.

The main objection with the prior art designs is that they employ complex, external planetary gearing, or an external gear transmission unit, or an external differential gear assembly.

The Kauertz U.S. Pat. No. 3,144,007 describes a rotary radial-piston internal combustion engine comprising a common cylinder for at least two concentric pistons each having a pair of diametrically opposite vanes. Adjacent vanes respectively belong to the two pistons and form between them a working chamber. A control linkage interconnects the pistons for relative angular displacement about their common axis to contract and enlarge periodically the working chamber. The control linkage comprises a planetary gear rigidly connected with one of the pistons and meshing with a sun gear coaxial with the shafts thereof, and a connecting rod eccentrically journaled to the planet gear and pivotally connected to the other piston. Thus, upon a relative rotation of the planet and sun gears, the two pistons will be angularly reciprocated toward and away from one another to expand or contract the working chambers.

The Seybold U.S. Pat. No. 3,955,541 discloses a rotary internal combustion engine comprising a water-cooled housing having a large cylindrical bore in which a hollow rotor with axially spaced side walls is free to rotate and on which two wedge-shaped, diametrically opposed pistons are mounted. The pistons cooperate with similarly shaped reaction elements enclosed in this cylindrical rotor, and they are mounted on a multiple-splined shaft. A gear transmission unit causes the reactor elements to remain stationary during ignition and expansion, and they are then accelerated to reduce the gap between the pistons and the reactor elements to exhaust the burned gases and/or compress the intake mixture of gas and air before ignition takes place.

The Hutterer U.S. Pat. No. 3,981,638 discloses a rotary piston machine which has a substantially annular working space that is divided by bars or pistons into a plurality of sealed chambers. The bars or pistons are carried by two coaxial drums which perform a differential rotational movement. A differential gear assembly for the pistons comprises a bevel gear which comprises four bevel wheels which mesh with each other. The differential gear assembly also comprises an epicyclic or planet wheel assembly.

The Baer U.S. Pat. No. 4,068,985 discloses a rotary engine or pump having rotating energy chambers whose size is modified by oscillatory movement of symmetrically supported radially extending movable walls or pistons toward and away from one another in the course of rotation. It employs translational means to translate the oscillatory movement of the movable walls into a rotational movement to drive the drive shaft. Couplings between the movable walls or pistons and the drive shaft include a crank connection at a radial extension of the shaft permitting oscillation of each movable wall. There is also an edge wall assembly relative to the crank support on the shaft extension. The crank support is a planet gear shaft that carries a pinion which meshes witha sun or ring gear on the housing. Thus as the crank arm rotates about this gear shaft, it turns the shaft extension and hence the shaft, thus tending to keep rotation smooth and assuring that the movable walls have repeatable patterns of movement which are the same for every rotation.

OBJECTS OF THE PRESENT INVENTION

A principal object of the present invention is to provide a rotary piston machine or apparatus with two or more concentric rotating members and a centrally located, eccentrically mounted, oscillating coupling means between the two members to create alternate compression and expansion energy strokes.

A further object of the present invention is to provide a rotary piston machine of the class described wherein the oscillating coupling means includes an actuator lever that revolves around a fixed offset crank pin.

A further object of the present invention is to provide a rotary piston machine of the class described with a flexible connection means between each rotating member and the actuator lever.

A further object of the present invention is to provide a rotary piston machine of the class described wherein the mechanism may be reversed by holding the outer ring fixed and releasing the offset crank pin to rotate in the manner of a crankshaft for the actuator lever so that the inner ring member will oscillate with respect to the fixed outer ring member.

A further object of the present invention is to provide a rotary piston machine of the class described wherein one rotating member turns in one constant direction while the other rotating member accelerates in said one constant direction during one-half of a revolution and decelerates in the opposite direction during the other one-half of a revolution.

SUMMARY OF THE INVENTION

The present invention provides a rotary piston machine for use with a compressible fluid. This machine has a housing with walls forming a circular bore. There are two rotating members having a common central axis. One rotating member has two or more inwardly directed pistons, while the other rotating member has an equal number of outwardly directed pistons that are interposed between the other pistons to define energy chambers therebetween. An oscillating coupling means is centrally located within the two rotating members and is flexibly joined to both rotating members to cause one rotating member to accelerate with respect to the other rotating member during a first one-half revolution of the coupling means to create a compression stroke as well as to decelerate with respect to the other rotating member during the second one-half revolution of the coupling means to create an expansion stroke.

BRIEF DESCRIPTION OF THE DRAWINGS

This invention will be better understood from the following description taken in conjunction with the accompanying drawings and its scope will be pointed out in the appended claims.

Figure 5:
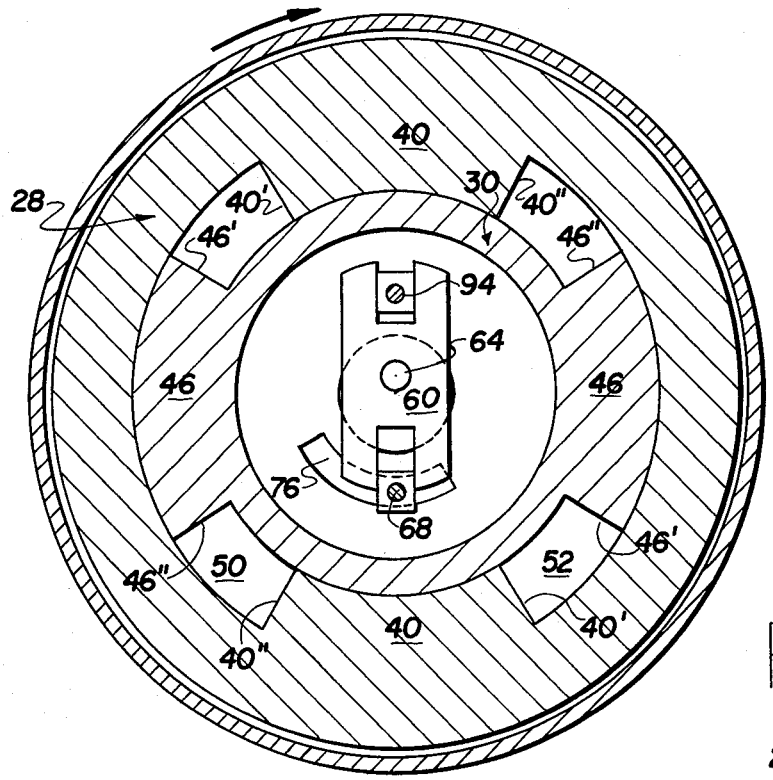
FIG. 5 is a cross-sectional plan view similar to FIGS. 2–4, with the actuator lever shown in its vertical 270° position, wherein the actuator lever has turned clockwise by a 90° angle from FIG. 4, and the inner ring has turned in a clockwise direction, but with a decelerating speed so that the inner pistons lag behind the outer pistons, and the inner pistons are generally located intermediate the outer pistons.

Discussing FIG. 2 again, it is both the 0° andthe 360° position wherein the actuator lever has turned clockwise by a 90° angle from FIG. 5 into a horizontal position, and the inner ring has turned in a clockwise direction, but with a decelerating speed so that the outer pistons catch up with the inner pistons and close with the inner pistons on the counterclockwise side.

Figure 2:
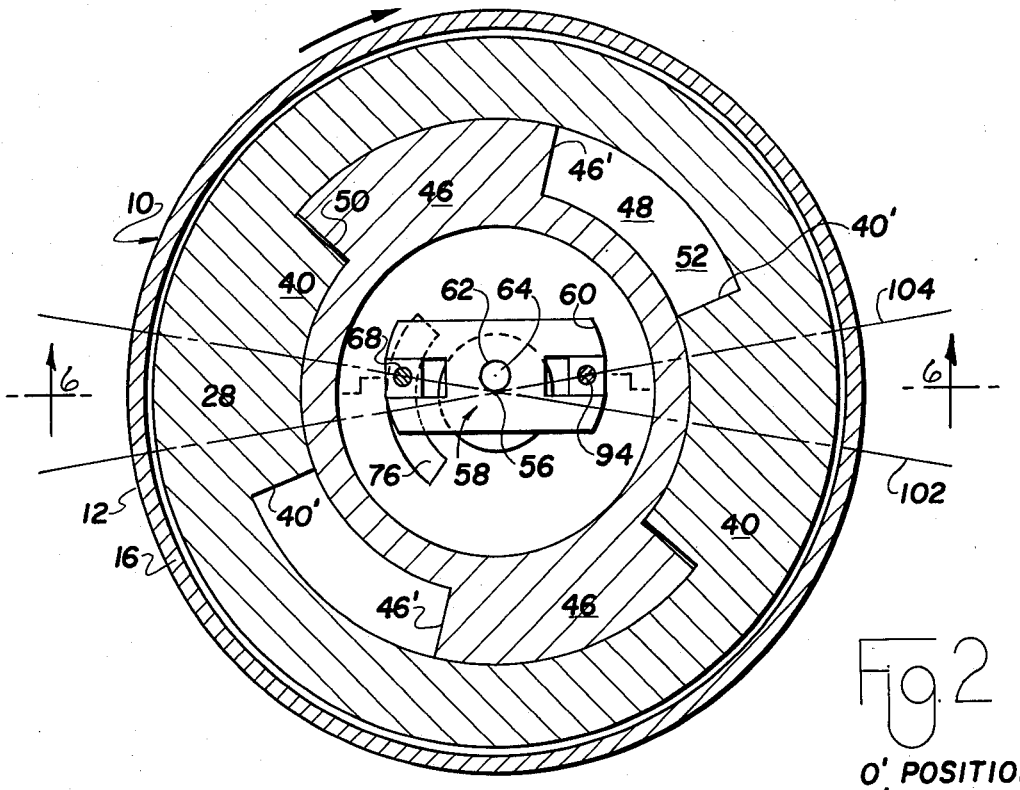
FIG. 2 is a cross-sectional plan view taken generally through the inner and outer rotating ring members, and showing the inner and outer pistons closed with respect to each other on the counter-clockwise side, as well as showing the actuator lever in a generally horizontal position or 0° position. Notice that the actuator lever is pivoted about a center crankpin that is offset from the geometric center of the inner and outer ring members.
Figure 3:
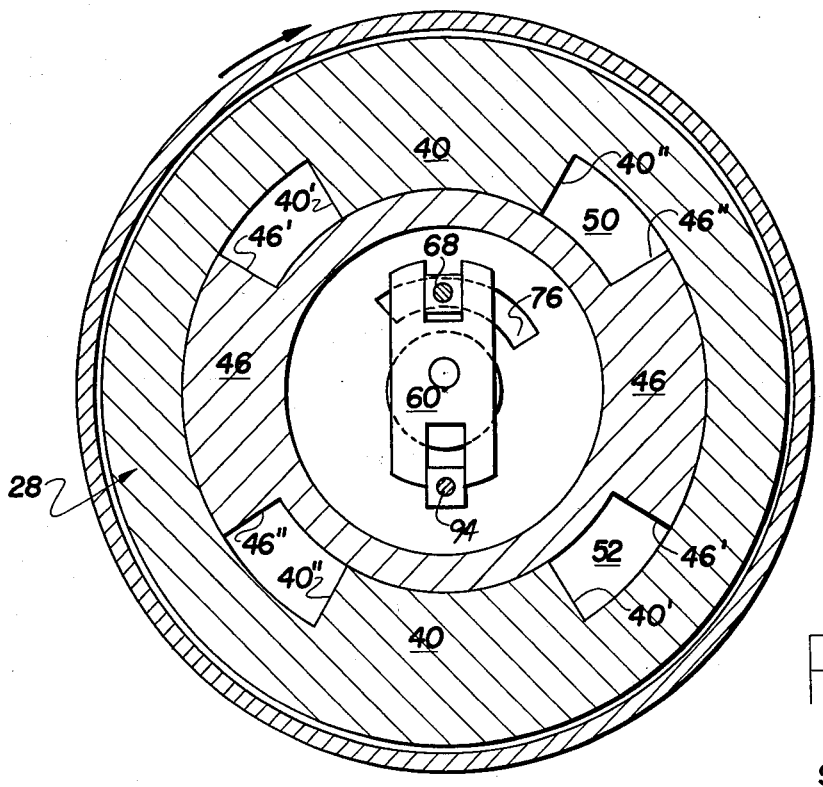
FIG. 3 is a cross-sectional plan view, similar to that of FIG. 2, with the actuator lever shown in its vertical 90° position wherein the actuator lever has turned clockwise by a 90° angle from FIG. 2, the outer ring has also turned clockwise at a constant speed, and the inner ring has also turned in a clockwise direction, but with an accelerating speed so that the inner pistons lead the outer pistons, and the inner pistons are generally located intermediate the outer pistons.

From FIG. 2 to FIG. 3, the inner ring and pistons are accelerating, and leading the outer pistons.

Figure 4:
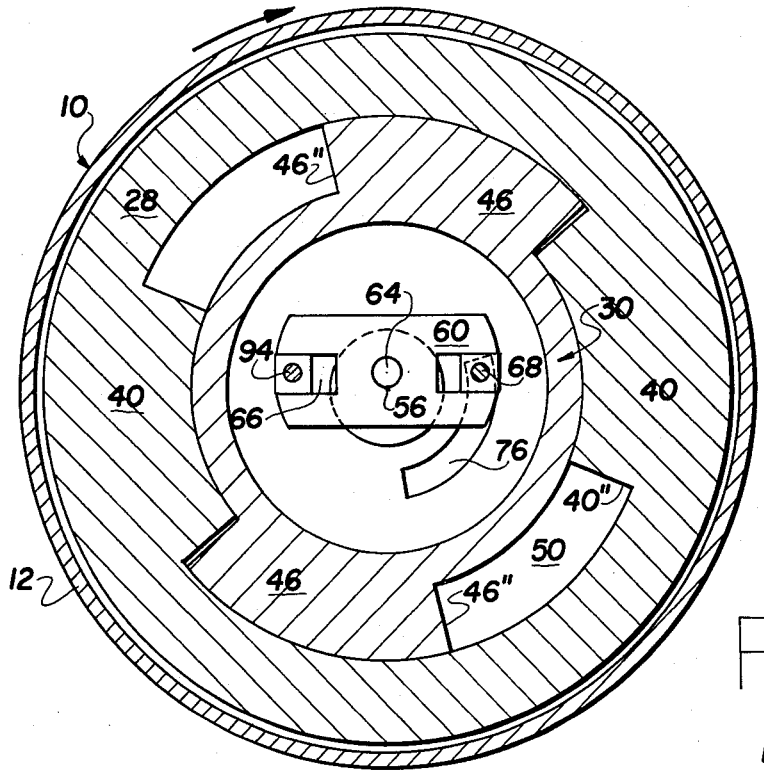
FIG. 4 is a cross-sectional plan view, similar to that of FIGS. 2 and 3, with the actuator lever shown in a horizontal 180° position, wherein the actuator lever has turned clockwise by a 90° angle from FIG. 3, and the inner ring has continued at an accelerating speed in the clockwise direction until the inner pistons were closed with respect to the outer pistons on the clockwise side.

From FIG. 3 to FIG. 4, the inner ring and pistons are accelerating, and catching up to the forward outer pistons.

From FIG. 4 to FIG. 5, the inner ring and pistons are decelerating, and lagging the outer pistons.

From FIG. 5 back to FIG. 2, the inner ring and pistons are decelerating, and the outer pistons catch up with the inner pistons.

DESCRIPTION OF THE PREFERRED EMBODIMENTS

Figure 1:
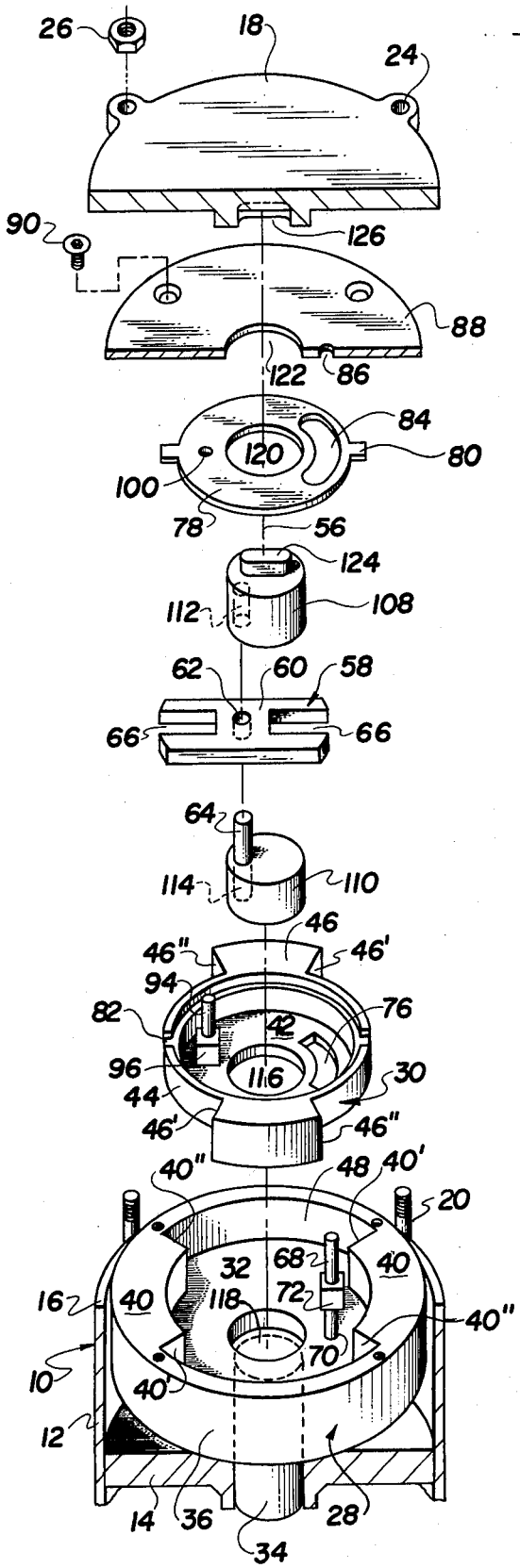
FIG. 1 is a vertically exploded view of the rotary piston mechanism of the present invention.

Turning now to a consideration of the drawings and, in particular, to the fragmentary vertical exploded view of FIG. 1, there is shown a rotary piston machine 10 having a housing 12 which serves as a frame of reference as in other engine structures relative to which other parts of the engine or pump move. The housing 12 has a support frame 14 and cylindrical side wall 16 and a removable top plate 18. Vertical mounting bolts 20 are made integral with the outside of the side wall 16. The top plate 18 has mounting ears 24 for receiving the bolts 20 therethrough. The assembly is held together by tightening the nuts 26 on the bolts. The above described housing components are given by way of example only. The fact is that the housing 12 is a hermetically closed assembly in which the engine parts or pump parts operate to perform their stated objective. Of course, the top wall 18 could be welded to the cylindrical casing 16, as is well known in the art of rotary compressors.

Figure 6:
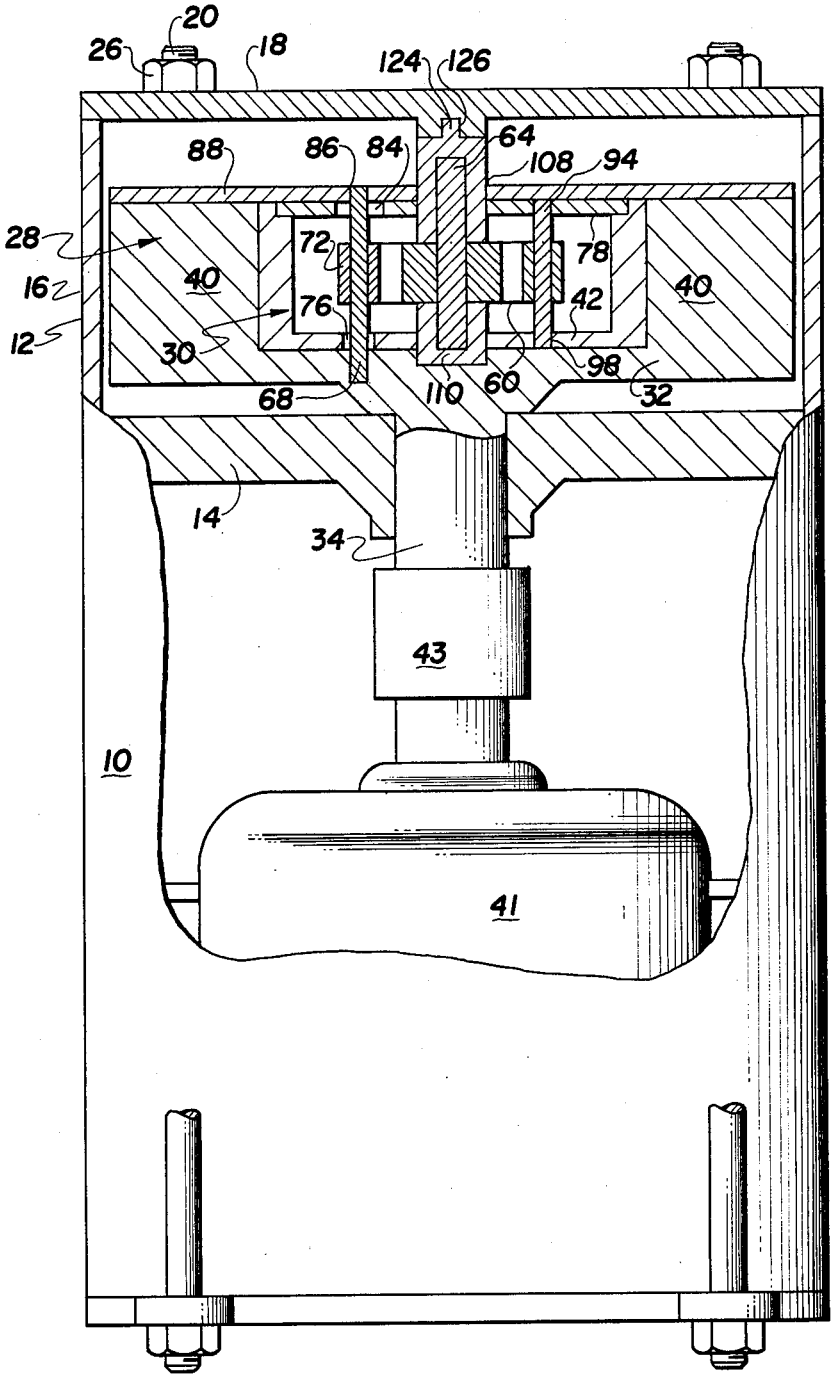
FIG. 6 is a vertical assembly view, partly in cross-section, of the rotary piston machine of FIG. 1.

The two main elements of this rotary piston mechanism are an outer ring member 28 and an inner ring member 30 that is seated within the outer ring member and carried thereby. Compare FIGS. 1 and 2. The outer ring member 28 has a bottom wall 32 with a centrally located, vertical motor shaft 34 on the underside thereof. The outer ring member also has a cylindrical side wall 36 and at least two integral, diametrically opposed, inwardly directed, segmental pistons 40. As is seen in FIG. 6, the bottom wall 32 of the outer ring member 28 is shown as an integral part of the outer ring member. It should be understood by those skilled in this art that in actual practice, to employ the best manufacturing techniques, the bottom wall 32 would be a separate cover plate like the top cover plate 88. Moreover, the shaft 34 would be a bearing shaft that is made integral with the bottom wall or cover plate 32. The present invention relates to the design and operation of a rotary piston machine, rather than the method of making the machine. An electric motor 41 is mounted in the housing 12 and joined to the shaft 34 by a coupling member 43.

The inner ring member 30 also has a bottom wall 42 and a cylindrical side wall 44 which fits snugly between the diametrically opposed outer pistons 40, as is best seen in FIG. 2. This integral bottom wall 42 would also be a separable cover plate held in place by a screw assembly (not shown) in actual production. The inner ring member 30 includes at least two integral, diametrically opposed, outwardly directed, segmental pistons 46. These inner pistons 46 are interposed in the space 48 between the outer pistons 40, and thus they define with the outer pistons energy chambers 50 and 52 therebetween.

The working faces of the outer pistons 40 are faces 40' and 40'', while the working faces of the inner pistons 46 and 46' and 46''. The outer surface of the cylindrical side wall 44 of the inner ring member 30 has a close sliding relationship with the two innermost surfaces of the outer pistons 40. Similarly, the outermost surfaces of the inner pistons 46 have a close sliding relationship with the inner surface of cylindrical side wall 36 of the outer ring member 28.

Each energy chamber 50 and 52 would be supplied by intake and exhaust ports, which are shown in the accompanying drawings.

FIGS. 9–17, wherein the same elements that are depicted in FIGS. 1–8 are identified by the same reference numerals. An intake tube 148 is mounted through the housing 12, and it is joined into the rotary coupling 43. This rotary coupling 43 communicates with a hollow bore 150 of the shaft 34. Two horizontal radial conduits 152 communicate with the top portion of the bore 150, and each conduit has an outermost vertical extension 154 which is open at the top surface of the bottom wall 32 of the outer ring member 28. It should be noted that the outer pistons 40 are formed as separate members from the outer ring 28 in FIGS. 9 and 10, while the outer pistons 40 were shown as integral with the outer ring 28 in FIGS. 1 and 6. This change is necessary for manufacturing purposes. Element 149 is a partial showing of an exhaust tube.

Figure 11:
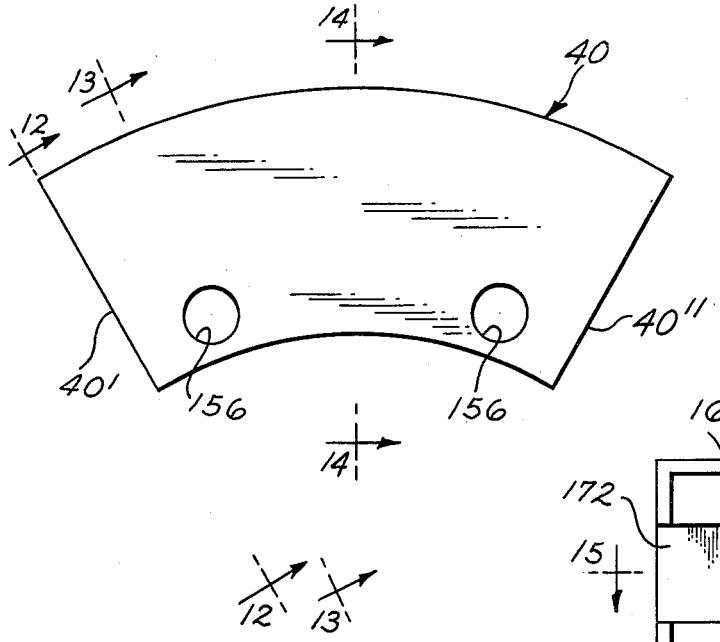
FIG. 11 is a top plan view on an enlarged scale of one of the outer pistons as depicted in FIG. 9.

The specific nature of the outer pistons 40 is best illustrated in FIGS. 11–17. FIG. 11 shows one outer piston 40 in top plan view, and it is shown with a top discharge hole 156 adjacent each end.

Figure 12:
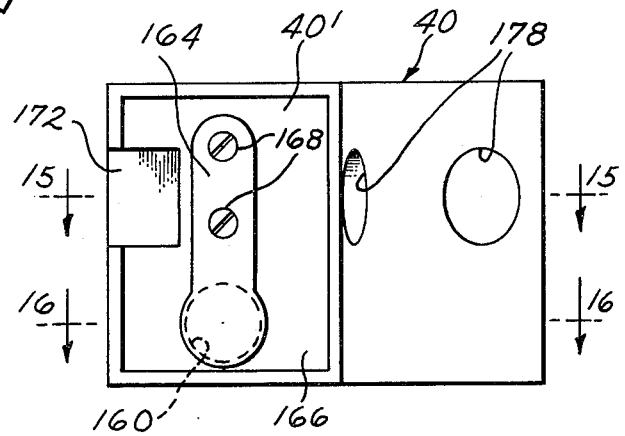
FIG. 12 is a vertical elevational view of the working face at the left side of the outer piston of FIG. 11.
Figure 13:
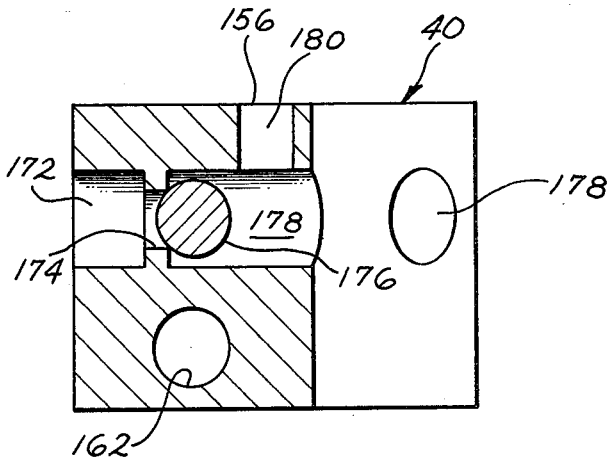
FIG. 13 is a transverse, cross-sectional, elevational view of one of the outer pistons taken on the line 13—13 of FIG. 11.
Figure 14:
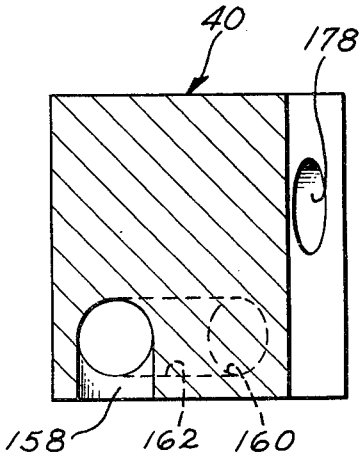
FIG. 14 is a transverse, cross-sectional, elevational view of one of the outer pistons taken on the line 14—14 of FIG. 11.
Figure 15:
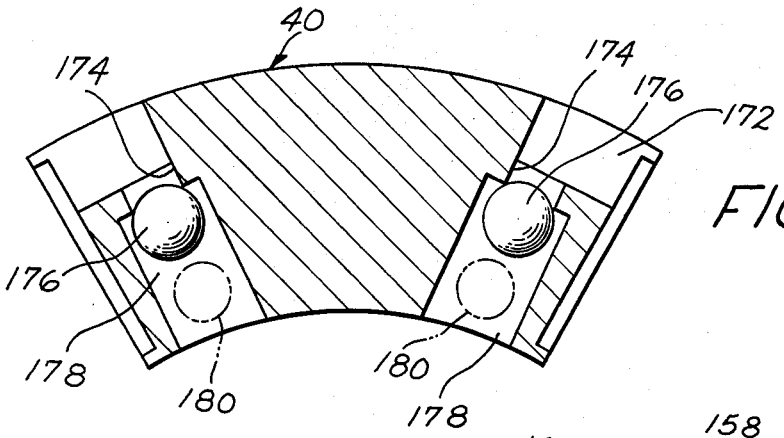
FIG. 15 is a cross-sectional plan view of one of the outer pistons taken on the line 15—15 of FIG. 12.
Figure 16:
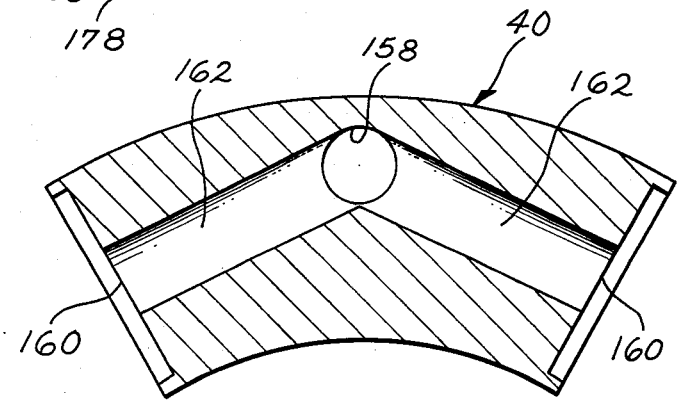
FIG. 16 is a cross-sectional plan view of one of the outer pistons taken on the line 16—16 of FIG. 12.
Figure 17:
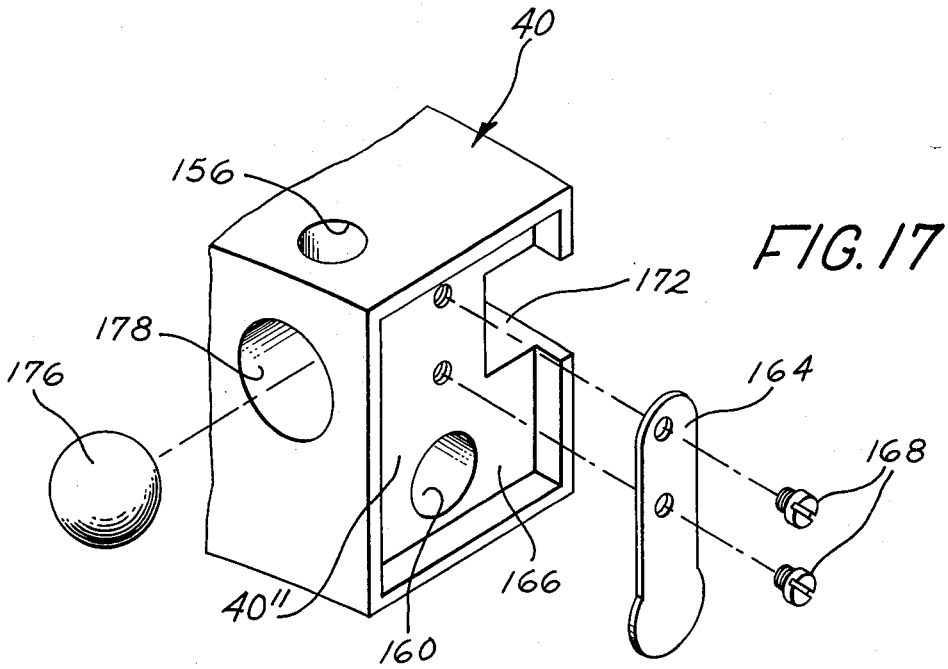
FIG. 17 is a fragmentary, exploded, perspective view of the right side of the outer piston of FIG. 11 showing the reed valve and the ball valve for operating the various flow patterns.

FIG. 12 is a left side elevational view of the outer piston 40 of FIG. 11 taken on the line 12—12 thereof. FIG. 16 is a cross-sectional plan view that is taken on the line 16—16 of FIG. 12, and there is a central, short vertical duct 158 in the piston which is adapted to be aligned with the top opening of the vertical extension 154 that is in the bottom wall 32. A suction port 160 is formed in each piston face 40' and 40'', and each port 160 has a horizontal duct 162 that communicates with the central, short vertical duct 158, as is best seen in FIGS. 16 and 17. Fastened over the suction port 160 is a normally closed reed valve 164, which is mounted in a recessed piston face 166 by means of screw fasteners 168.

Each piston face 40' and 40'' also has an exhaust port 172. This exhaust port has a right angularly arranged valve seat 174, which accommodates a ball valve 176, which is positioned in an enlarged chamber 178 that is furnished with a top, vertical discharge duct 180. The top portion of this duct has the top discharge hole 156, as mentioned previously. It should be understood that this ball valve 176 is operated by centrifugal force to a normally closed position with the valve seat 174.

Figure 9:
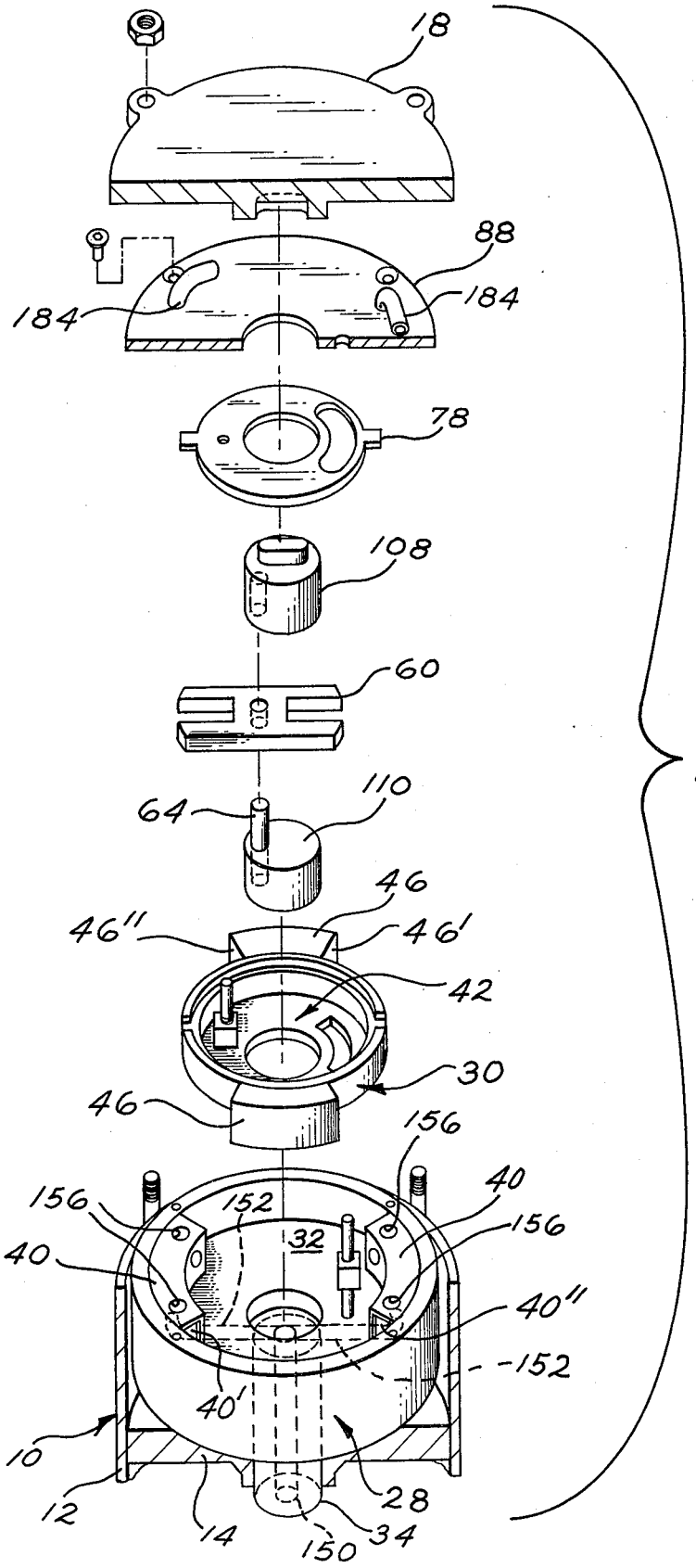
FIG. 9 is a vertically exploded view of the rotary piston mechanism of the present invention similar to that of FIG. 1 but modified to depict in general terms the intake and exhaust means to the energy chambers.
Figure 10:
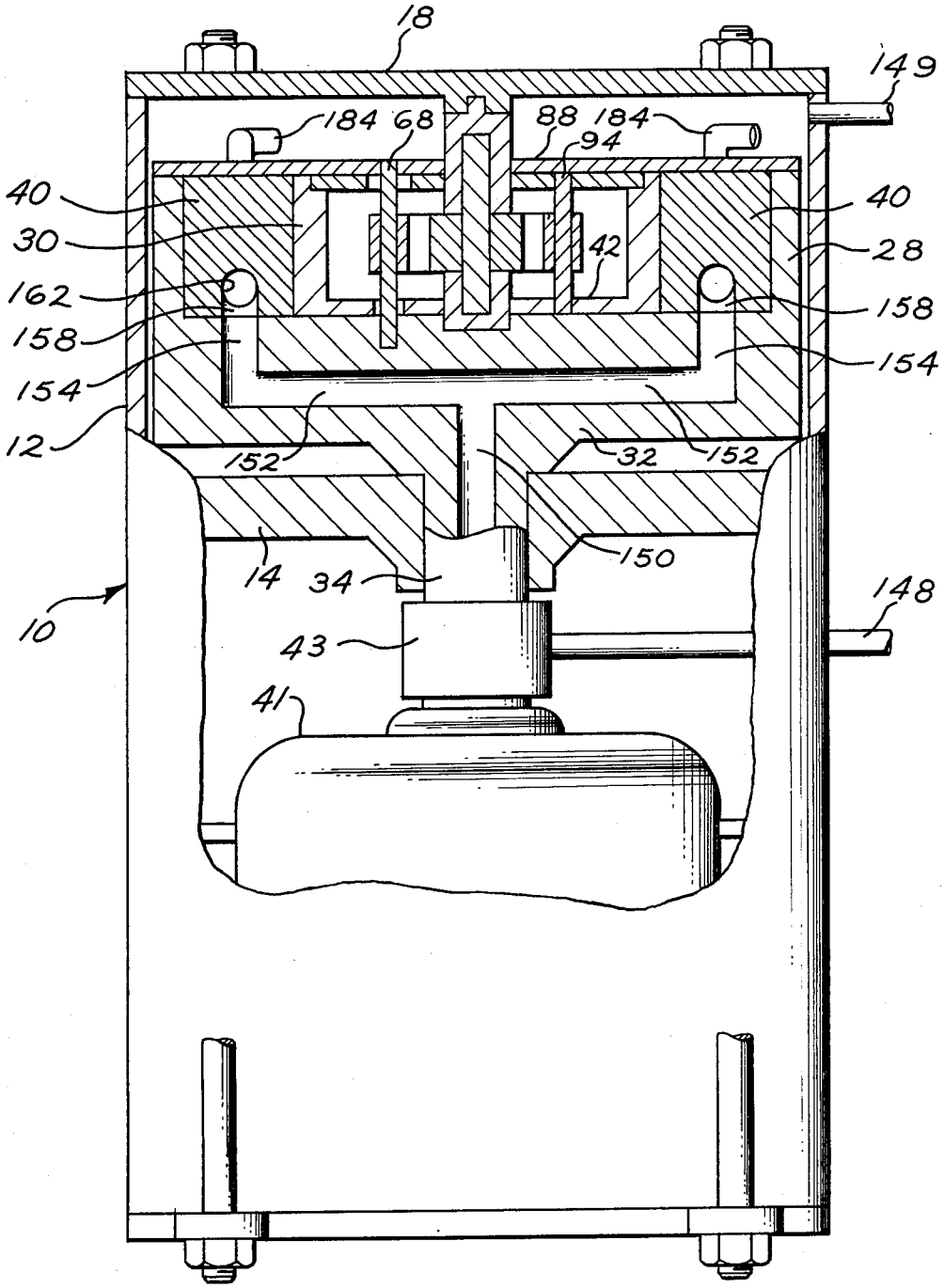
FIG. 10 is a vertical assembly view, partly in cross-section, of the rotary piston machine of FIG. 9, but similar to the showing in FIG. 6.

Thus, as seen in FIG. 9, there are four top discharge holes 156. Accordingly, there are four aligned discharge reaction jets 184 in the top cover plate 88, each jet to be aligned with the top discharge hole 156, and each jet being directed in a rearwardly concentric direction with relation to the center of rotation of the outer ring member 28. The above explanation of the intake and exhaust means for the energy chambers 50 and 52 of this rotary piston mechanism is by way of example in order to complete the explanation of an entire system for carrying out the present invention. It should be understood that this intake and exhaust means does not form part of the present invention as it is not being specifically claimed. It should be understood by those skilled in this art that many alternate methods of supplying fluids to the energy chambers could be substituted without departing from the present invention.

The outer and inner ring members 28 and 30 are concentric, rotating members that turn about the geometric centerline 56 of the shaft 34 and housing 12. For the purposes of this explanation the ring members 28 and 30 are shown turning in a clockwise direction.

There is an oscillating coupling means 58 positioned within the inner ring member for flexibly joining the inner and outer ring members so they are able to change positions with relation to each other as they revolve around their common axis and thereby create compression and expansion strokes.

The flexible coupling means 58 comprises an actuator lever 60 that rotates at its center 62 around a fixed offset crankpin 64. Each end of the actuator lever 60 has an elongated slot 66. The longitudinal centerline through the two slots 66, 66 extends through the center axis of the center hole 62, as is best seen in FIG. 2. The outer ring member 28 carries a wristpin 68 that is captured in one slot 66 of the actuator lever 60 for making a sliding or flexible connection between the outer ring and the actuator lever. The wristpin 68 is a vertical member that is parallel to the vertical, geometric centerline 56 of the machine 10, and it extends into a support hole 70 in the bottom wall 14 of the outer ring member. A pivoted, block-like shoe 72 is supported on the wristpin to fit into the slot 66 and engage the parallel walls that form the slot, as is clear in FIGS. 2 and 6.

An oversized arcuate slot 76 is formed in the bottom wall 42 of the inner ring 30 so the wristpin 68 may extend up through the arcuate slot and not interfere with the oscillating movement of the inner ring member relative to the outer ring member. The top portion of the inner ring member 30 is fitted with a cover plate 78 that is mounted flush therewith. The cover plate 78 has a pair of outwardly extending ears 80 which fit down into mating slots 82 in the upper edge of the cylindrical side wall 44 of the inner ring member to lock the cover plate from turning. This cover plate 78 also has an oversized arcuate slot 84 that generally overlies the arcuate slot 76 in the bottom wall of the inner ring member so the wristpin 68 may extend freely therethrough. The top portion of the wristpin 68 is supported in a hole 86 in a top cover plate 88 that is sealed over the top of the outer ring member 28 by means of fastening screws 90.

The inner ring member 30 also carries a vertical wristpin 94 for making a sliding or flexible connection between the inner ring and the actuator lever. This second wristpin 94 also has a pivoted shoe 96 for working engagement within the other elongated slot 66 of the actuator lever 60. The lower end of the wristpin 94 extends into a support hole 98 in the bottom wall 42 of the inner ring member, as is best seen in FIG. 6. The top portion of the second wristpin 94 is supported in a hole 100 in the top cover plate 78 of the inner ring member.

The two wristpins 68 and 94 are substantially equidistant from the vertical, geometric centerline 56 of the machine 10. Moreover, the first wristpin 68 is located on a centerline drawn through the vertical, geometric centerline 56 and the center of the two outer pistons 40, 40, as illustrated in FIG. 2. In a similar manner, the second wristpin 94 is located on a centerline 104 drawn through the vertical, geometric centerline 56 and the center of the space between the two inner pistons 46, 46. At the same time, a line drawn through the centers of the two wristpins 68 and 94 intersects the centerline of the offset crankpin 64, as is best seen in FIG. 2.

Thus, it should be clear that the two wristpins 68 and 94 move in a fixed circle around the vertical, geometric centerline 56, while the actuator lever 60 rotates around the offset crankpin 64.

Before describing the oscillating motion of the inner ring member 30 with relation to the outer pistons of the outer ring member 28 in the diagrams of FIGS. 2–5, the nature of the support for the offset crankpin 64 will be explained.

Fitted to the offset crankpin 64 is an upper and a lower stub shaft 108 and 110, respectively as is best seen in FIGS. 1 and 6. These two stub shafts have their vertical centerline coinciding with the centerline 56 of the machine. The crankpin 64 is elongated. First the actuator lever 60 is slipped onto the crankpin 64. Then the offset hole 112 of the upper stub shaft 108 is forced down onto the crankpin, and the offset hole 114 of the lower stub shaft 110 is forced up onto the lower end of the crankpin to form a subassembly.

A portion of the lower stub shaft 110 fits down through a hole 116 in the bottom wall 42 of the inner ring member 30, and its lower end is seated in a circular bearing 118 in the bottom wall 32 of the outer ring member 28.

A portion of the upper stub shaft 108 fits up through a hole 120 in the top cover plate 78, as well as up through a hole 122 in the top cover plate 88. The top end of the upper stub shaft 108 is fitted with a key 124 that is adapted to lock within a keyway 126 in the underside of the removable top plate 18. Thus the two stub shafts 108 and 110 are fixed, as well as the offset crankpin 64 being fixed.

Now turning to a consideration of the operational plan views of FIGS. 2–5, FIG. 2 represents both the 0° position and the 360° position after the rotary piston mechanism has made a complete revolution. This designation 0° position is not a critical position, but only a starting place of frame of reference for purposes of illustration. The actuator lever 60 is shown in a generally horizontal position and the outer and inner pistons 40 and 46 respectively are shown closed with respect to each other on the counter-clockwise side.

It is well to note carefully that the outer and inner pistons and the actuator lever of FIG. 2 are not shown in the same position as these same parts are positioned in FIG. 1. These parts have been repositioned in FIG. 2 so that the outer and inner portions will be closed on the counterclockwise side. It so happens that when this occurs the actuator lever is in a horizontal position. The two wristpins 68 and 94, as shown in FIG. 2, are reversed from their positions in FIG. 1. Remember that wristpin 68 is integral with the outer ring 28 and hence the outer pistons 40, 40; while the other wristpin 94 is integral with the inner ring 30 and hence the inner pistons 46, 46.

For the purpose of explaining the operation of the rotary piston machine as depicted in FIGS. 2–5, the direction of rotation of the rotary mechanism is shown by way of example as clockwise. Thus in FIG. 3 the 90° position, the outer ring member 28 is turning at a constant speed, clockwise; and the wristpin 68 is carried along with it, which in turn drives the actuator lever 60, and the lever in turn drives the wristpin 94 which turns the inner ring member 30. Remember that the two wristpins 68 and 94 turn about a center that coincides with the geometric centerline 56, while the actuator lever rotates about the offset crankpin 64. Thus in comparing the 90° position of FIG. 3 with FIG. 2, the outer ring wristpin 68 has turned clockwise for less than 90°, while the inner ring wristpin 94 has turned clockwise for more than 90°. As stated earlier, the wristpin 94 is integral with respect to the inner pistons 46, 46. Thus the greater than 90° movement of the inner ring wristpin 94 causes the inner pistons 46, 46 to accelerate with respect to the outer pistons 40, 40. The two outer pistons 40, 40 are shown in the 12 o'clock and 6 o'clock positions, while the inner pistons 46, 46 are shown generally intermediate the two outer pistons. The two wristpins are also in the 12 o'clock and 6 o'clock positions.

Now comparing FIG. 4 the 180° position with FIG. 3 the 90° position, the outer ring wristpin 68 has turned clockwise less than 90°, while the inner ring wristpin 94 has turned clockwise more than 90°. This means that the inner ring continues to accelerate, and in so doing the inner pistons 46, 46 close with respect to the outer pistons 40, 40 on the clockwise side, thereby creating a compression stroke on the forward side of the inner pistons.

Now comparing the 270° position of FIG. 5 with the 180° position of FIG. 4, the outer ring wristpin 68 has turned clockwise more than 90°, while the inner ring wristpin 94 has turned clockwise less than 90°. This action means that the inner pistons are decelerating relative to the speed of the outer pistons. Notice in FIG. 5 that the inner pistons are in their intermediate position between the two outer pistons, in a manner similar to the 90° position of FIG. 3. Also in FIG. 5, the two outer pistons 40, 40 are in the 12 o'clock and the 6 o'clock positions.

Now a comparison will be made of the 270° position of FIG. 5 and the 360° position of FIG. 2. In FIG. 2, the outer ring wristpin 68 has turned clockwise more than 90° from FIG. 5, while inner ring wristpin 94 has turned clockwise less than 90° from FIG. 5. This action means that the inner pistons continue to decelerate relative to the speed of the outer pistons. The result is that the outer pistons 40, 40 catch up with the inner pistons, and the pistons are closed on the counterclockwise side. This action creates a compression stroke on the rearward side of the inner pistons.

The operating principle of this invention is that the rotation of the two concentric outer and inner ring members 28 and 30 causes the actuator lever 60 to rotate around a fixed offset crankpin which in turn causes the inner ring member to accelerate during a 180° movement and to decelerate during the next 180° movement. In its simplest terms the entire rotary piston mechanism rotates around the fixed offset crankpin, or fixed crank.

Another modification would be to hold the outer ring member stationary and release the offset crankpin to rotate in the manner of a crankshaft for the actuator lever. The inner ring member would be free to oscillate between the pistons of the stationary outer ring member. The offset crankpin would be allowed to turn in a circular path which would create the moving force for the oscillating inner ring member, or the moving force could be created by admitting internal or external combustion gases into the energy chambers.

Figure 7:
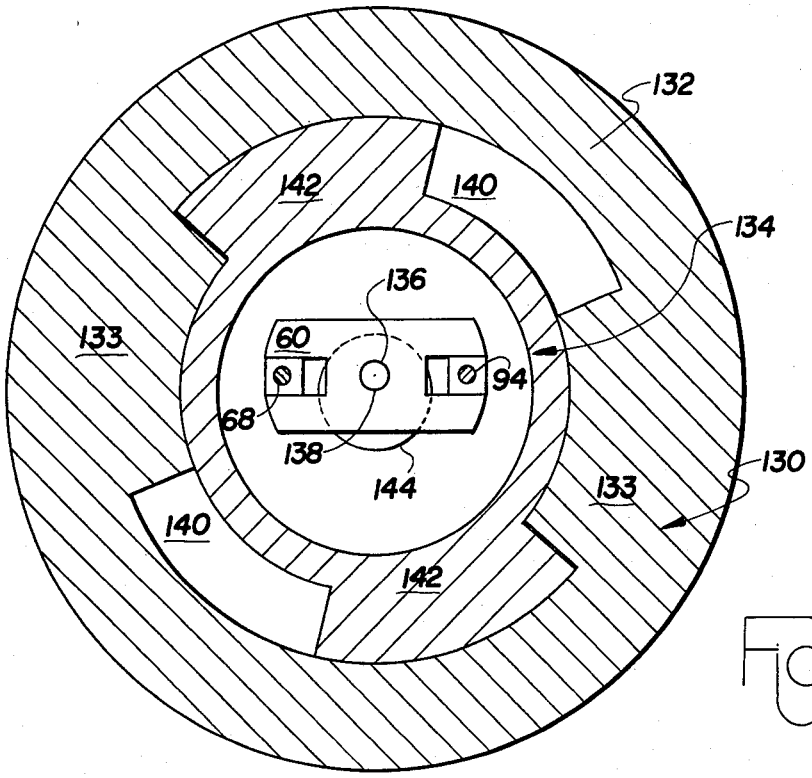
FIG. 7 is a cross-sectional plan view of a modification of the present invention showing the outer ring member fixed and the offset crankpin released to rotate about the geometric centerline of the machine.
Figure 8:
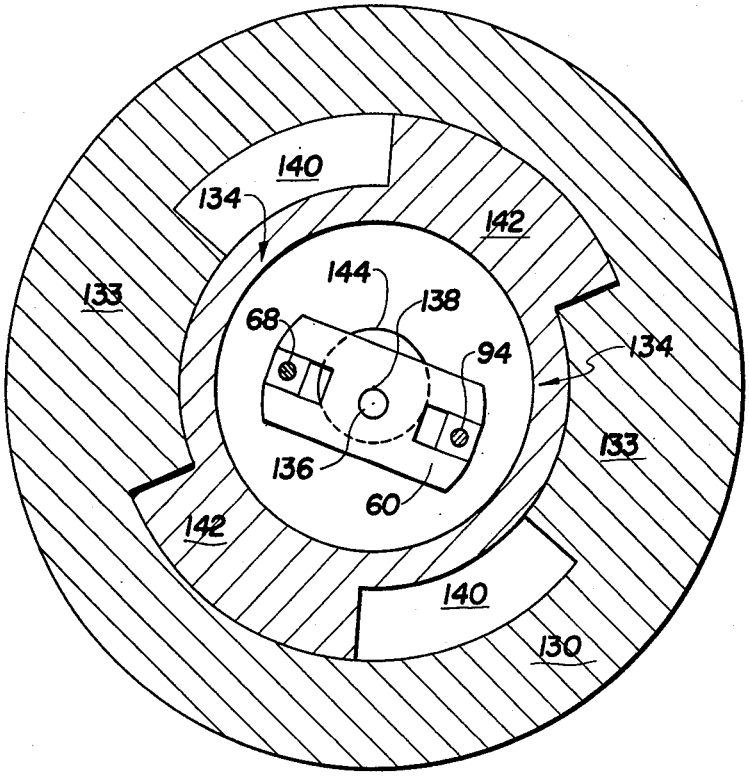
FIG. 8 is a view similar to FIG. 7 showing how the inner ring member oscillates between the positions of FIGS. 7 and 8.

FIG. 7 shows a modification 130 of the present invention where the outer ring member 132 with its pistons 133 is fixed and the inner ring member 134 oscillates in place. This embodiment is made by holding the outer ring member 132 stationary and allowing the offset crankpin 136 to rotate about the geometric centerline 138. External combustion gases could be introduced into the energy chambers 140 to power the movable pistons 142 of the inner ring member 134 back and forth, or the offset crankpin 136 could be rotated as a crankshaft 144 by another external power source. Such an oscillating piston engine could be supplied to each wheel of a vehicle as the motive force. The wristpin 68 of the fixed outer ring member 132 is likewise fixed, while the wristpin 94 of the inner ring member 134 is movable with the inner ring member, as is seen in comparing FIGS. 7 and 8. The actuator lever 60 is pivotally supported on the travelling crankpin 136.

Having described above my invention of a rotary piston machine, it will readily be apparent to those skilled in this art that the present invention is directed to a rotary piston machine or mechanical movement that can be used on an internal/external combustion engine, gas compressor, gas or liquid metering device or combination of an expander/compressor where a gas is compressed on one side of the device, then exhausted or pressurized through a heat exchanger or condenser coil and returned while still pressurized to the expander side of the device where some of the energy that is used to compress the gas is recovered.

Since there is a piston face 40', 46' and 40'', 46'' at each end of the energy chambers 52 and 50, respectively, there is a high percentage of energy utilization. On conventional four-cycle internal combustion, reciprocating engines, there is only one power stroke per crankshaft throw for every two turns of the crankshaft. The present invention, if used as a four-cycle internal combustion engine has one power stroke for every revolution of the rotary mechanism.

The horsepower of the rotary piston engine of the present invention per cubic foot and per pound of engine weight would be increased considerably over the prior art. On conventional reciprocating piston and crankshaft engines, the length of the piston stroke has to be equal to twice the throw of the crankshaft. The present invention is not restricted by this limitation. The exhaustion of the combustion gases from the energy chambers would be assisted by the centrifugal force generated by the complete rotary action of the mechanism. Moreover, this rotary piston mechanism could be used more advantageously with the Sterling cycle than the original reciprocating piston engine.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A rotary piston machine operable with a compressible fluid and comprising in combination:

a. a housing having walls forming a circular bore, b. an outer ring member rotatably mounted within the housing about a central axis and including at least two integral diametrically opposed inwardly directed segmental pistons, c. a concentric inner ring member positioned within and carried by the said outer ring member and including at least two integral diametrically opposed outwardly directed segmental pistons which are interposed between the said outer pistons and define with the outer ring pistons energy chambers therebetween, d. and an oscillating coupling means positioned within the inner ring member and rotating around a fixed offset crankpin to cause the inner ring member to accelerate with respect to the outer ring during a first one-half revolution of the coupling means to create a compression stroke on its forward side and to decelerate with respect to the outer ring during the second one-half revolution of the coupling means to create a compression stroke on its rearward side.

2. A rotary piston machine as recited in claim 1 wherein the said oscillating coupling means comprises an actuator lever that is mounted to rotate about the fixed offset crankpin and is flexibly connected to both the outer and inner ring members.

3. The invention as recited in claim 2 wherein the said actuator lever comprises an elongated slot at each end that are arranged in tandem, and both the outer and inner ring members include a wristpin which operates within one of the elongated slots respectively to form the flexible connection between the ring members and the actuator lever.

4. The invention as recited in claim 3 wherein both of said wristpins are arranged parallel to the central axis of the concentric ring members and generally equidistant therefrom.

5. The invention as recited in claim 4 wherein the said housing includes means for forming a hermetic seal thereof, and the outer ring member has a central shaft extending from one end thereof, and motor means joined to the shaft for driving the machine as a pump or compressor.

6. The invention as recited in claim 4 wherein the said housing includes means for forming a hermetic seal thereof, and the outer ring member has a central shaft extending from one end thereof, and the said machine is operated as an internal/external combustion rotary engine that drives the said shaft.

7. The invention as recited in claims 3 or 4 wherein the said wristpin for the outer ring member is positioned generally on a centerline drawn between the two outer pistons and substantially through the central axis of the machine, while the said wristpin for the inner ring member is positioned generally on a centerline drawn between the spaces separating the two inner pistons and substantially through the central axis of the machine.

8. The invention as recited in claims 1, 2, 3 or 4 wherein the said outer ring member includes a bottom wall and a generally cylindrical side wall with an open top portion, and a top cover plate is fastened over the outer ring member to seal the inner ring member therein.

9. The invention as recited in claim 8 wherein the said fixed offset crankpin is supported in a central stub shaft that is fixed at one end to an adjacent end of the said housing, and serves at its other end as a central bearing of the inner ring member relative to the outer ring member.

10. The invention as recited in claim 9 wherein the said inner ring member includes a bottom wall and a generally cylindrical side wall with an open top portion, and a top cover plate fastened over the inner ring member, the wristpin of the outer ring member being supported at one end by the bottom wall of the outer ring member and extending freely through the bottom wall of the inner ring member and through the top cover plate of the inner ring member, the other end of the outer wristpin being supported by the top cover plate of the outer ring member, while the wristpin of the inner ring member is supported at one end by the bottom wall of the inner ring member and at its other end by the top cover plate of the inner ring member.

11. A piston machine operable with a compressible fluid and comprising in combination:

a. a hollow housing having an outer ring member that includes at least two integral diametrically opposed inwardly directed segmental outer pistons, b. a concentric inner ring member positioned within the outer ring member and including at least two integral diametrically opposed outwardly directed segmental pistons which are interposed between the said outer pistons and define energy chambers between the inner and outer pistons, c. said outer ring member being fixed while the inner ring member is free to oscillate, d. and a rotatable offset crankarm flexibly connected to the outer and inner members by means of an actuator lever supported therefrom, and both offset crank arm and actuator lever being within the inner ring member for creating an oscillating motion of the inner ring member relative to the fixed outer ring member, e. and drive means for moving the free oscillating member.

12. The invention as recited in claim 11 wherein the actuator lever is mounted to rotate about the rotatable offset crankarm and is flexibly connected to both the said outer and inner members.

13. The invention as recited in claim 12 wherein the said actuator lever includes an elongated slot at each end that are arranged in tandem, and both the outer and inner ring members include a wristpin which operates within one of the elongated slots to form the said flexible connection between the two members and the actuator lever.

* * * * *